73-151 SR
6/21/77 OR 4,030,354

United States Patent [19] [11] 4,030,354
Scott [45] June 21, 1977

[54] TESTING OF RAM AND ANNULAR BLOWOUT PREVENTERS

[76] Inventor: Kenneth F. Scott, 321 Woodmont, Gretna, La. 70053

[22] Filed: Feb. 27, 1976

[21] Appl. No.: 662,256

[52] U.S. Cl. ..... 73/151
[51] Int. Cl.[2] ..... E21B 47/10
[58] Field of Search ..... 166/250; 175/40; 73/151, 40.5 R, 49.1, 49.6, 49.8

[56] References Cited

UNITED STATES PATENTS

| | | | |
|---|---|---|---|
| 3,177,703 | 4/1965 | Waters et al. | 73/40.5 R |
| 3,443,643 | 5/1969 | Jones | 73/151 X |
| 3,872,713 | 3/1975 | Ilfrey et al. | 73/151 X |

*Primary Examiner*—Jerry W. Myracle
*Attorney, Agent, or Firm*—Cushman, Darby & Cushman

[57] ABSTRACT

The test sub is attached to the drill pipe by screw type connections. The bottom connection of the test sub is screwed into a telescoping joint (variable length joint of drill pipe) or a pup joint (short joint of drill pipe). The telescoping joint or pup joint is then screwed into a test plug. This assembly is lowered into the control hookup until the test plug seats in the wellhead. The test plug seats and forms a pressure seal in the wellhead. The length of the telescoping joint and/or pup joint is such that the distance between the top of the test sub and the bottom of the test plug is the same as the distance between the top of the annular preventer and the center of the wellhead.

The casing rams are closed around the test sub and test fluid is pumped through this assembly through the test plug and between the sub and the control hookup. Pressure is applied to the casing rams and control hookup through the test fluid. The process is the same when testing the annular preventer. In the latter test, the casing rams are in the open position with the bag of the annular preventer closed around the test sub.

5 Claims, 2 Drawing Figures

TESTING OF RAM AND ANNULAR BLOWOUT PREVENTERS

BACKGROUND OF THE INVENTION

A typical blowout preventer stack includes a plurality of ram-type preventers surmounted by an annular or bag-type preventer. Typical ram-type preventers are made by Cameron Iron Works, OCT and Schaefer Tool Works. Typical annular preventers are made by Hydril.

In such a stack there are generally at least two ram-type preventers: one with blind rams for closing off communication with the well bore when no pipe extends through the preventers and another with pipe rams for closing off the annulus between the well bore and the pipe. For instance, while the well is being drilled deeper, one of the ram-type preventers have semi-cylindrically concave confronting nose portions capable of being rapidly urged toward one another to circumferentially grip the drill pipe should subterranean pressures suddenly increase to such an extent as to significantly raise the likelihood that the pressure will lift the drill pipe string substantially.

When drilling has reached a depth such that a string of casing is to be run into the well and cemented, it is a wide-spread practice to change out the pipe rams of the respective ram-type preventer and install casing rams in that preventer. The ram-type preventers in widest use are made so that the rams can be exchanged without removing the housing of the preventer from the stack.

Where the driller can afford to tie up more equipment in the drilling of one well, where space permits, or where applicable regulations require it, and where it makes good economic sense, such as in the offshore drilling of wells in deep water with a mudline suspension system, drillers often use a blowout preventer stack which has more than two ram type preventers, for instance one with blind rams, one with rams for drill pipe and others with rams for various diameters of casing to be run.

In former instance, the changing of rams takes time, and each time a set of rams is changed, procedures must be followed to test the integrity of the seals between the peripheries of the rams and the housing of the respective preventer.

It is virtually drilling industry-wide practice to test pipe rams for drilling pipe against a joint of drilling pipe before a stage of drilling is begun, in order to ascertain, before the point of necessity, whether the pipe rams are likely to function properly and hold against a blowout that might happen during the anticipated drilling stage.

This is done by threadably securing a test plug or packer on a joint of drill pipe, lowering this into the well until the test plug or packer is below the blowout preventers, and seating or expanding the test plug or packer into sealing engagement with the well bore. This isolates the preventers from the well for the purpose of testing. Then the pipe rams are closed about the pipe and the annulus outside the pipe, between the test plug and the closed rams is filled with fluid and pressurized. The fluid pressure in the closed volume is monitored over a given period to detect any leakage. A mechanical strain may also be pulled on the pipe at this time to test whether the rams are likely to successfully both contain the pressure and restrain the pipe against upward movement in a blow-out.

The efficacy of the annular preventers is generally similarly tested against the drill pipe. In such a test, the pipe rams are retracted and the toric bag of the annular preventer is radially contracted about the pipe.

It may surprise those not directly connected with well drilling, but it is currently neither the practice nor a specific regulatory requirement that casing rams be similarly tested prior to running a string of casing into a well. (It is a general practice to test the integrity of the seals between the casing rams and the respective blowout preventer body, but that is a matter distinct from testing whether, in the event of a blowout during running and cementing of a string of casing, the casing rams would likely be effective to seal the relevant annulus should the annular preventer also leak, and prevent the casing string from rising).

There are at least two practical reasons why the testing of casing rams has not been routinely practiced.

Prior to the present invention, it would be necessary to run a full joint of casing into the well in order to perform the test. This is impractical.

Test plugs are normally sold with a drill pipe thread on them, because, for years, drillers have run pipe with a test plug in order to test the pipe rams. Drill pipe is typically of relatively small diameter, e.g. 4½ inches, and has a thread style that is particularly designed to resist twisting off when the drill string is rotated to make a hole. Casing is of varied sizes, a typical well has casing of three different diameters, each being substantially larger in diameter than drill pipe. A typical casing diameter is 10¾ inches.

If drillers were to simply scale the method and apparatus used for testing pipe rams against pipe to the practice of testing casing rams against casing, they would need plugs with casing joint threads, plug they would need to switch to tongs, slips and elevators for handling casing, at a stage when pipe handling tools had been used and would soon need to be used again — a seeming waste of time, manpower and capital resources.

SUMMARY OF THE INVENTION

The present invention provides ways and means for testing casing rams before casing is run. At the heart of the new method and apparatus is a short piece of casing of specific length, connected between two sections of drill pipe, to permit testing of casing rams, while handling the device as if it were drill pipe. Thus, conventional test plugs may be fitted on its lower section of the drill pipe and the device may be handled using normal pipe handling tools.

The test sub is attached to the drill pipe by screw type connection. The bottom connection of the test sub is screwed into a telescoping joint (variable length joint of drill pipe) or a pup joint (short joint of drill pipe). The telescoping joint or pup joint is then screwed into a test plug. This assembly is lowered into the control hookup until the test plug seats in the wellhead. The test plug seats and forms a pressure seal in the wellhead. The length of the telescoping joint and/or pup joint is such that the distance between the top of the test sub and the bottom of the test plug is the same as the distance between the top of the annular preventer and the center of the wellhead.

The casing rams are closed around the test sub and test fluid is pumped through this assembly through the test plug and between the sub and the control hookup. Pressure is applied to the casing rams and control hookup through the test fluid. The process is the same when testing the annular preventer. In the latter test, the casing rams are in the open position with the bag of the annular preventer closed around the test sub.

The principles of the invention will be further discussed with reference to the drawing wherein a preferred embodiment is shown. The specifics illustrated in the drawing is intended to exemplify, rather than limit, aspects of the invention as defined in the claims.

BRIEF DESCRIPTION OF THE DRAWINGS IN THE DRAWING

FIG. 1 is a longitudinal sectional view of the device in use, with the test sub extending in the blowout preventer stack from below the casing rams to above the bag of the annular preventer; and FIG. 2 is a fragmentary longitudinal sectional view of the test sub of FIG. 1 with preferred accessories.

DETAILED DESCRIPTION OF THE PRESENTLY PREFERRED EMBODIMENT

Figure 1:
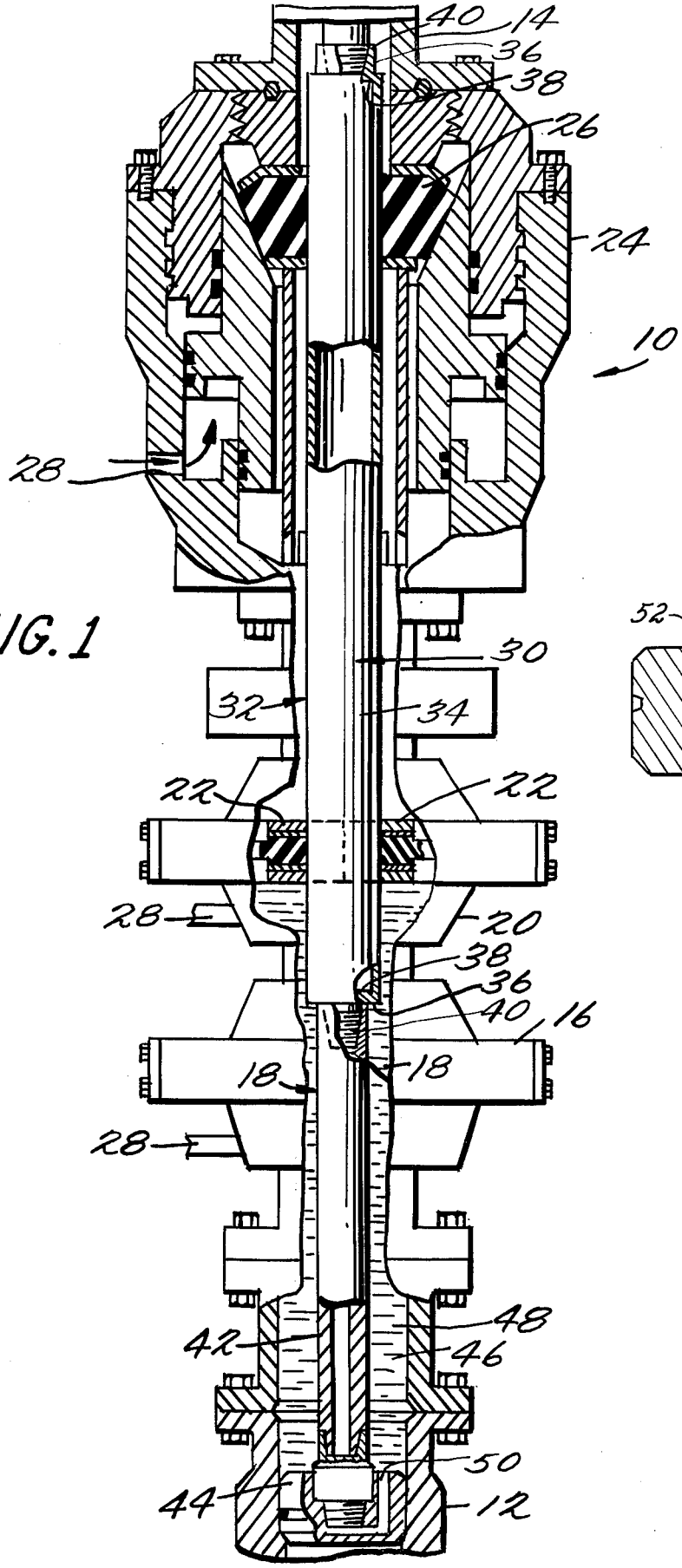

A conventional blowout preventer stack 10 is mounted on the wellhead 12 and a riser 14 extends from the stack 10 to the surface. The typical blowout preventer stack 10 is seen to include a first ram-type preventer 16 with blind rams 18, a second ram-type preventer 20 whose pipe rams have been changed out for casing rams 22, and an annular preventer 24 with a radially expansible — contractile toric bag 26. The blowout preventers are equipped with conventional control means, 28 for operating the rams and bag.

The test apparatus 30 includes a test sub 32 rated to the API standard mill test pressure of the casing to be run through the control hookup being tested. In practice, the test sub 32 is constituted by a short section 34 of casing of the same diameter as the casing that is to be run. An adapter 36 is secured, as by welding, on each end of the casing section. Each adapter shown is constituted by an annular plate 38 secured on the respective end of the casing section, and a pin end or box end 40 cut from respective ends of a drill pipe joint and coaxially secured to the casing section. Thus a special member is provided, a sub which has the outside diameter of a casing over a length equal to the distance from above the bag 26 to below the casing rams 22, and terminates in drill pipe — sized and threaded connectors 40.

When casing rams are to be tested, after the seals between the various rams and housings have been tested, a telescoping or pup joint of drill pipe 42 is threaded into a conventional test plug 44. The lower connector 40 of the sub 32 is threaded into the joint 42 and a string of drill pipe is made up with its lower end threaded into the upper connector of the upper connector 40 of the sub 32. The assembly is run into the well until the test plug 44 is conventionally seated in the wellhead and forms a pressure seal. The length of the telescoping joint or pup joint 42 is such that the distance between the top of the test sub and the bottom of the test plug is the same as the distance between the top of the annular preventer and the center of the wellhead.

Then the casing rams are closed around the casing section of the test sub and test fluid 46, liquid or gas, is pumped through the device 30 and out through the test plug into the annulus section 48 outside of the test device 30, within the blowout preventer stack and down to the wellhead limited at the bottom by the test plug, at the top by the closed casing rams. Pressure is applied to the casing rams and control hookup through the control fluid. Standard fluid pressure monitoring and/or mechanical stressing techniques are then employed to determine whether the casing rams are sealing and holding.

The process is substantially the same for testing the annular preventer, in which case the casing rams are retracted to open and the bag of the annular preventer is contracted about the casing section of the test sub 32.

When the casing rams and annular preventer have been tested against the test sub, the test apparatus 30 is withdrawn from the well.

Some conventional test plugs, like the one illustrated at 44 have a channel 50 which permits circulation of fluid down the drill pipe bore, through the test plug channel 50 and up the annulus between the drill pipe and the casing, liner or formation as the case may be, and vice versa. Other conventional plugs have no channel, or one which communicates the drill pipe bore with the underside of the plug. In order to permit the apparatus of the invention to be used with any of these conventional test plugs, the pin end of the test sub is preferably provided with accessory features as shown in FIG. 2.

Figure 2:
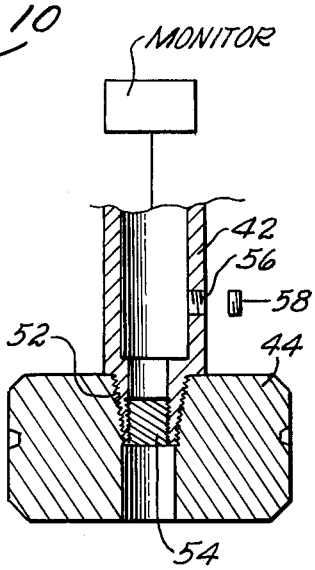

In FIG. 2, the bore of the pin end of the test sub 42 is internally threaded at 52 and provided with a threadedly removable blanking plug 54. Also, a small diameter, internally threaded weep hole opening 56 is provided radially through the wall of the test sub 42 adjacent the pin end and that opening is provided with a threadedly removably blanking plug 58. Accordingly, by running the test sub 42 in various permutations of the blanking plugs 54 and 58 being present or absent, and in combination with various designs of conventional test plugs as aforesaid, pressure can be applied to or monitored from either the drill pipe or the annulus.

It should now be apparent that the testing of ram and annular blowout preventers as described hereinabove, possesses each of the attributes set forth in the specification under the heading "Summary of the Invention" hereinbefore. Because the testing of ram and annular blowout preventers can be modified to some extent without departing from the principles of the invention as they have been outlined and explained in this specification, the present invention should be understood as encompassing all such modifications as are within the spirit and scope of the following claims.

What is claimed is:

1. For testing the sealing and holding characteristics of an annular blowout preventer with a radially expansible-contractile bag and a casing rams-equipped blowout preventer, which are arranged one above the other in a blowout preventer stack, in turn mounted on a wellhead, comprising:

a test sub having casing-simulating section with an outer diameter equal to that of the string of casing against which the two preventers are designed to operate, said casing-simulating section of the test sub having a length at least equal to the distance between the top of the bag of the annular blowout preventer and the bottom of the casing rams of the casing rams-equipped blowout preventer, said test sub being provided at its upper and lower ends with respective threaded connectors for threadable connection with respective joints of drill pipe, a joint of drill pipe having its upper end threaded to the lower threaded connector of the test sub;

a test plug, the lower end of said joint of drill pipe being threaded into the test plug;

a string of drill pipe having its lower end threaded to the upper threaded connector of the test sub, to complete a testing device constituted by the string of drill pipe, test sub, joint of drill pipe and test plug, whereby the testing device may be run into a well to a level at which the test plug seats in the wellhead and the casing-simulating section of the test sub is positioned to be circumferentially engaged, in turn, by the casing rams and the bag of the annular blowout preventer.

2. The apparatus of claim 1, wherein:

the joint of drill pipe threadably connecting between the test plug and the test sub is a pup joint.

3. The apparatus of claim 1, wherein:

the joint of drill pipe threadably connecting between the test plug and the test sub is a telescopic joint of drill pipe.

4. A method for testing the sealing and holding characteristics of an annular blowout preventer with a radially expansible-contractile bag and a casing rams-equipped blowout preventer, which are arranged one above the other in a blowout preventer stack, in turn mounted on a wellhead, comprising:

making up and running into the well until it seats a string of drill pipe having a test plug at the lower end thereof and incorporating a larger diameter section, of the diameter of the casing which the casing rams are designed to seal against, said section being of such length and placement in the string of drill pipe, that when the test plug seats in the wellhead the section is in position to be alternately circumferentially gripped by the casing rams and the bag of the annular preventer;

opening the annular preventer, closing the casing rams on said larger diameter section, introducing pressurized fluid into the annulus outside said string between the casing rams and the test plug, and monitoring for leakage from the annulus, of pressurized fluid;

opening the casing rams, closing the annular preventer on said larger diameter section, introducing pressurized fluid into the annulus outside said string between the annular preventer and the test plug, and monitoring for leakage of pressurized fluid from the annulus;

opening the annular preventer and pulling the string of drill pipe, test plug and incorporated larger diameter section from the well.

5. A method for testing the sealing and holding characteristics of an annular blowout preventer with a radially expansible-contractile bag and a casing rams-equipped blowout preventer, which are arranged one above the other in a blowout preventer stack, in turn mounted on a wellhead, comprising:

making up and running into the well until it seats a string of drill pipe having a test plug at the lower end thereof and incorporating a larger diameter section, of the diameter of the casing which the casing rams are designed to seal against, said section being of such length and placement in the string of drill pipe, that when the test plug seats in the wellhead the section is in position to be alternately circumferentially gripped by the casing rams and the bag of the annular preventer;

opening the annular preventer, closing the casing rams on said larger diameter section, introducing pressurized fluid into the annulus outside said string between the casing rams and the test plug, and monitoring for leakage from the annulus, of pressurized fluid;

by monitoring pressure within the drill pipe;

opening the casing rams, closing the annular preventer on said larger diameter section, introducing pressurized fluid from within the drill pipe into the annulus outside said string between the annular preventer and the test plug, and monitoring for leakage from the annulus, of pressurized fluid by monitoring pressure within the drill pipe;

opening the annular preventer and pulling the string of drill pipe, test plug and incorporated larger diameter section from the well.

* * * * *